US010539928B2

(12) United States Patent
Born et al.

(10) Patent No.: US 10,539,928 B2
(45) Date of Patent: Jan. 21, 2020

(54) SMART WATCH WINDING DEVICE

(71) Applicant: The Swatch Group Research and Development Ltd, Marin (CH)

(72) Inventors: Jean-Jacques Born, Morges (CH); Cedric Nicolas, Neuchatel (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 93 days.

(21) Appl. No.: 15/848,314

(22) Filed: Dec. 20, 2017

(65) Prior Publication Data

US 2018/0181075 A1 Jun. 28, 2018

(30) Foreign Application Priority Data

Dec. 22, 2016 (EP) ..... 16206047

(51) Int. Cl.
*G04D 7/00* (2006.01)
*G04D 7/08* (2006.01)
(Continued)

(52) U.S. Cl.
CPC ..... *G04D 7/009* (2013.01); *G04B 3/006* (2013.01); *G04D 7/003* (2013.01); *G04D 7/087* (2013.01);
(Continued)

(58) Field of Classification Search
CPC ..... G04D 7/003; G04D 7/009; G04D 7/087; G04D 7/1214; G04D 7/1264;
(Continued)

(56) References Cited

U.S. PATENT DOCUMENTS 2,712,231 A * 7/1955 Frolow ..... G04D 7/1221 324/76.49
3,926,048 A * 12/1975 Uebelhart ..... G04D 7/1214 73/1.48
(Continued)

FOREIGN PATENT DOCUMENTS

EP 2650735 A2 * 10/2013
EP 3 096 191 A1 11/2016
(Continued)

OTHER PUBLICATIONS

European Search Report dated Jul. 6, 2017 in European Application 16206047.9, filed on Dec. 22, 2016 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A watch winding device includes a motor driving a winding operation, an acoustic measurer of the oscillator of a watch in the winding position, and a controller analysing the signals transmitted by the measurer and comparing them to desired values that can be parameterized to regulate the operation of the motor by starting this motor when the operating amplitude of the oscillator is less than a minimum value, and by stopping this motor when the working amplitude is higher than a maximum value, these acoustic measurers are fixed in a base behind an sensing opening of the acoustic sensor. The device includes an acoustic duct which places a receiving port, located inside a chamber for housing a watch, in communication with a transmitting port movable by the motor facing this sensing opening.

5 Claims, 1 Drawing Sheet

(51) Int. Cl.
*G04D 7/12* (2006.01)
*G04B 3/00* (2006.01)
*G04D 1/06* (2006.01)

(52) U.S. Cl.
CPC ..... *G04D 7/1264* (2013.01); *G04D 7/1292* (2013.01); *G04D 1/06* (2013.01); *G04D 7/1214* (2013.01)

(58) Field of Classification Search
CPC ..... G04D 7/1292; G04D 1/06; G04B 3/006; G04B 5/00; G04B 5/02; G04B 5/22; G04C 1/06; G04C 1/10
See application file for complete search history.

(56) References Cited

U.S. PATENT DOCUMENTS 4,028,927 A * 6/1977 Kikuyama ..... G04D 7/1214 73/1.48
4,078,419 A * 3/1978 Busch ..... G04D 7/1214 73/1.44
4,271,493 A * 6/1981 Tamaru ..... G04B 19/25373 368/28
2013/0329533 A1* 12/2013 Winkler ..... G01L 7/102 368/147
2014/0003200 A1 1/2014 Lamarche
2015/0338829 A1* 11/2015 Bossart ..... G04D 7/082 368/175
2018/0341226 A1* 11/2018 Favre ..... A47F 3/10
2018/0348707 A1* 12/2018 Lehmann ..... G04D 1/063

FOREIGN PATENT DOCUMENTS

FR 3 019 321 A1 10/2015
WO WO 2012/126978 A1 9/2012

* cited by examiner

SMART WATCH WINDING DEVICE

This application claims priority from European patent application No. 16206047.9 filed on Dec. 22, 2016, the entire disclosure of which is hereby incorporated herein by reference.

FIELD OF THE INVENTION

The invention concerns a watch winding device, for mechanical watches or electronic watches with a mechanical energy source, comprising at least one energy source, arranged to power at least one motor, arranged either to turn the winding crown of a manually wound watch, or to drive at least one oscillating weight of a self-winding automatic watch, or to rock at least one self-winding automatic watch, said device comprising control means which include first acoustic measuring means which incorporate sensor means for acoustic measurement of the oscillator of at least one watch placed in the winding position, said control means being arranged to analyse signals transmitted by said first acoustic measuring means and compare them to desired values which can be parameterized to regulate the operation of at least one said motor by starting said motor when the operating amplitude of said oscillator is less than or equal to a first, minimum value, and by stopping said motor when the operating amplitude of said oscillator is higher than or equal to a second, maximum value.

The invention also concerns a timepiece assembly comprising such a device, and at least one mechanical watch, or an electronic watch with a mechanical power source, arranged to be fixed on at least one support.

The invention also concerns the use of such a device for winding a watch.

The invention also concerns a preparation method for a watch.

The invention concerns the field of horology, and more particularly the winding of mechanical watches or electronic watches with a mechanical power source, and especially, but not exclusively, automatic watches.

BACKGROUND OF THE INVENTION

The user of a manual or self-winding mechanical watch or electronic watch with a mechanical power source, which is not permanently worn, is obliged, when he wishes to use the watch, to perform display updating tasks, which may be tedious as regards the date, or difficult or even impossible as regards complications such as the moon phase or leap years in a perpetual calendar.

There are known watch winder boxes or individual devices which simulate the movements of a user by rotating the watch, generally about several axes, to give the oscillating weight the impulses required for winding, or to turn the crown of a manually wound watch, where permitted by the crown. These winder boxes or devices are often bulky, expensive and may disturb the user as they move. In particular, such winders are not suitable for a commercial environment, where a watch has to be exhibited in a static fashion to clients, with a correct time information display, and also be ready for demonstration.

These winding mechanisms, which are more or less complicated, tend to place too much stress on the mechanical system of the watch. In fact, even when they provide programming of the number of turns to be made for winding, these mechanisms allow for a safety factor, and wind the barrel more than necessary, which results in over-winding of the mainspring, which is dissipated by the slipping spring. Consequently, the entire mechanical system is subjected to higher stresses than necessary. The resulting effects are abnormal wear, and pollution from wear debris, which also impairs the lubrication of the watch, and can require more frequent cleaning and lubrication servicing operations, which represents a not insignificant cost for the user.

Moreover, excessive winding places unnecessary stress on the energy sources, which are sometimes of limited capacity, especially in the case of winding systems that use a battery or solar cells or suchlike.

SUMMARY OF THE INVENTION

The invention proposes to make available to the user simple, inexpensive and compact means for winding a mechanical watch or electronic watch with a mechanical energy source, and for permanently maintaining a correct display of time information, and maximum power reserve potential, even if the watch is not worn, whilst sparing the mechanical parts of the movement, and saving energy.

To this end, the invention concerns a watch winding device according to claim 1.

The invention also concerns a timepiece assembly comprising such a device, and at least one mechanical watch or electronic watch with a mechanical energy source, arranged to be fixed on at least one said support.

The invention also concerns the use of such a device for winding a watch.

The invention also concerns a method for preparing a watch according to claim 7.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
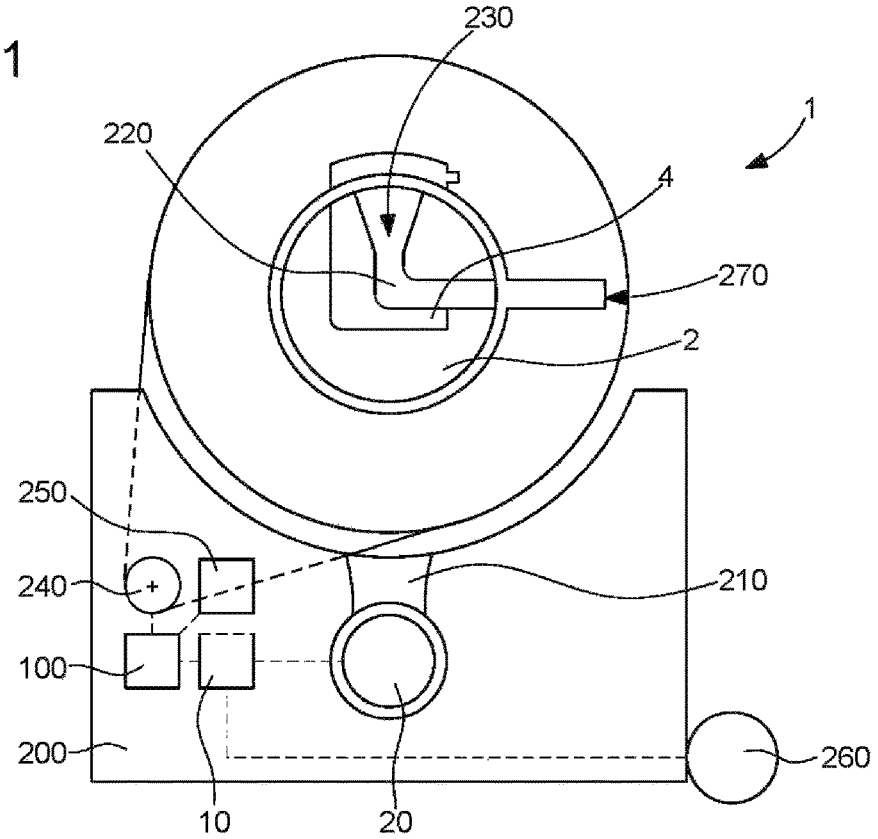
FIG. 1 represents a schematic, cross-sectional view of a watch winding device, particularly for mechanical watches or electronic watches with a mechanical energy source, according to the invention, with a support pivotally mounted on a motor and ready for receiving a mechanical watch or electronic watch with a mechanical energy source, which includes a chip integrating recommended operating parameters.
Figure 2:
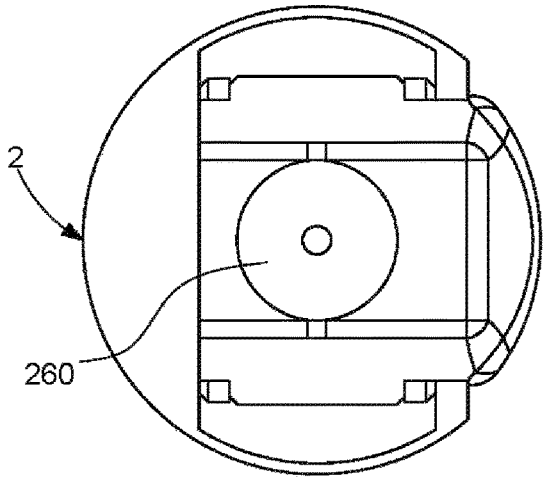
FIGS. 2 and 3 schematically represent top and axial cross-sectional views of a support comprising an acoustic duct according to the invention.
Figure 3:
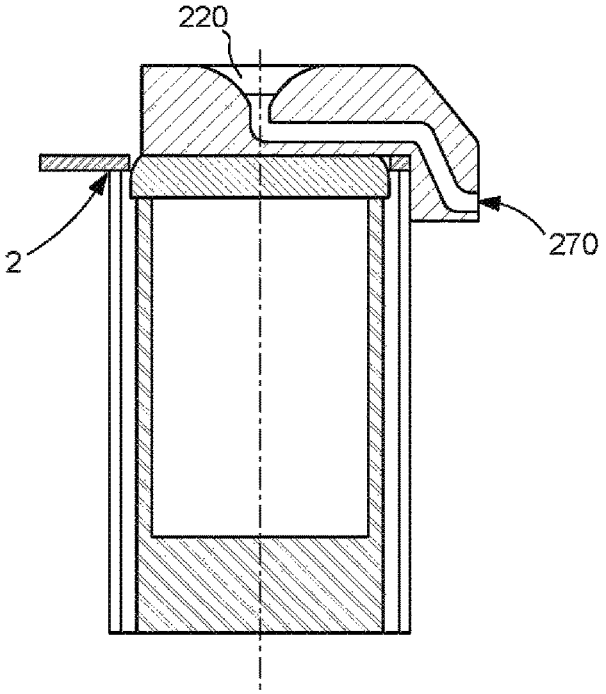

The invention proposes to develop a winder that avoids undue stress on the mechanical parts of the watch movement, and saves energy.

A 'watch' means here any watch capable of being recharged with energy by a motion imparted thereto, or by an action on a winding crown: a mechanical self-winding or manual winding watch, or an electronic watch using mechanical energy, of the 'Autoquartz' or 'Automeca' type, or similar. The device according to the invention winds the watch to exactly the right degree.

'Winding" also means recharging such a watch with energy.

For an ordinary mechanical watch, the optimum is to keep the winding of the mainspring to a level at which the amplitude of the oscillator, formed by a balance/balance-spring assembly in most cases, is close to 250°. This value corresponds to reasonable winding of the mechanism, and to a watch rate that is most accurate in all positions.

The invention implements simple servo means for winding a mechanical watch or an electronic watch with a mechanical energy source, applicable to the winding of a manually wound watch by means of the crown or by means of any other component provided for this purpose, and to the winding of a self-winding automatic watch, which is achieved, either by rocking the entire watch, or by an action without contact with the oscillating weight, as described, in particular, in European Patent Application EP2650735A2 by the same Applicant.

The Figures are for didactic purposes, and only illustrate the case of self-winding automatic watches by the application of motion in one rotational degree of freedom. 'Motor' means hereinafter drive means arranged to set a support in motion in at least one degree of freedom, which may be a single drive means for a single degree of freedom, or a combination of drive means for several degrees of freedom. The case of winding by means of the crown is not illustrated by the Figures, since those skilled in the art will have no particular difficulty in transposing the teaching of the invention thereto.

More particularly, the invention concerns a watch winding device 1, particularly for mechanical watches or electronic watches with a mechanical energy source.

In a particular variant, device 1 includes at least one support 2, which is movable with respect to a base 200 comprised in device 1, this support 2 being arranged for receiving a mechanical watch or an electronic watch with a mechanical power source in a winding position.

Device 1 includes at least one energy source 3 arranged to power at least one motor 4.

This motor 4 is arranged either to turn the winding crown of a manually wound watch, or to drive at least one oscillating weight of a self-winding automatic watch, or to rock at least one self-winding automatic watch.

Device 1 includes control means 100 which include first acoustic measuring means 10 which incorporate sensor means 20 for acoustic measurement of the oscillator of at least one watch placed in the winding position. These control means 100 are arranged to analyse signals transmitted by acoustic measuring means 10, and to compare them to desired values that can be parameterized, in order to regulate the operation of at least one such motor 4, by starting motor 4 when the operating amplitude of the oscillator is less than or equal to a first, minimum value, and by stopping motor 4 when the operating amplitude of the oscillator is higher than or equal to a second, maximum value.

According to the invention, these first acoustic measuring means 10 are arranged in a fixed position in a base 200 behind a sensing opening 210 forming an input of these acoustic sensor means 20.

Device 1 includes at least one acoustic duct, which places a receiving opening 220 located inside a chamber 230 for housing a watch, in communication with a transmitting port 270.

More particularly, when device 1 includes at least one support 2 for receiving a watch, each such support 2 includes an acoustic duct, which places a receiving opening 220 located inside a chamber 230 for housing a watch, in communication with a transmitting port 270 located at the periphery of support 2.

Control means 100 control drive means 240, which determine the motion and position in space of transmitting port 270, in order, during a programmed or user-initiated operation to measure the rate of a watch fixed inside housing 230, to position and immobilise transmitting port 270 in an indexing position facing sensing opening 210 and in immediate proximity to the latter or the contact thereof.

More particularly, when device 1 includes at least one support 2 for receiving a watch, control means 100 control drive means 240, which determine the motion and the position in space of support 2, in order, during a programmed or user-initiated operation to measure the rate of a watch fixed inside housing 230, to position and immobilise transmitting port 270 in an indexing position facing sensing opening 210 and in immediate proximity to the latter or to the contact thereof.

More particularly, device 1 includes optical means 250 which cooperate with control means 100 to reach the indexing position.

More particularly, device 1 includes second acoustic measuring means 260 for measuring ambient noise in proximity to the device during the measurement, and control means 100 are arranged to correct, by subtracting this ambient noise, the acoustic measurement made by first acoustic measuring means 10 during the measuring operation.

It is noted that the invention can be used for any type of oscillator, and in particular, in the case of an oscillator with a mechanical escapement, both for a Swiss lever escapement and for a coaxial or other escapement. In the case where the notion of alternation is different, as for a detent escapement, suitable parameterization must be carried out, without departing from the scope of the invention.

In the case of an electronic watch using mechanical energy, it is also possible to manage the charging of the accumulator in an optimum manner for 'Autoquartz' type movements, or the optimum speed of the generator of 'Automeca' type movements with specific parameterization.

'Desired values that can be parameterized' means here that these values depend on the watch model, and may, depending on the case, either be pre-entered during configuration of the winding device and stored, or read directly in the watch by a suitable reader device. These desired values that can be parameterized can also be modified and forced by the user, when device 1 is fitted with a user interface with inputs/outputs allowing modification of these parameterized values.

Control means 100 include, for example, calculating means, such as a microprocessor or suchlike, for processing the information from the sensors, from measuring means 10, from a user interface detailed below, from the energy source (s) 3, and for sending suitable commands to motor 4 or to motors 4 when there are several.

Device 1 may be dedicated to the winding of a single watch.

It may also be intended for the winding of several watches simultaneously, and will be referred to below as a 'multiple winder".

Thus, in a particular embodiment of such a multiple winder, which includes one or more motors 4, each motor 4 is intended for the winding of a particular group composed of one or more supports 2, each able to receive a single watch. Each support 2 includes dedicated sensor means 20. Control means 100 are arranged to control each motor 4 according to the signals received from the sensor means 20 associated with the various supports 2 of the particular group.

In a particular embodiment of a multiple winder, control means 100 are arranged to control each of motors 4 in a differentiated manner.

In another particular embodiment of a multiple winder, control means 100 are arranged to control the motor 4 assigned to said particular group by starting it as soon as the operating amplitude of any one of the oscillators of the watches carried by supports 2 of the particular group is less than or equal to a first, minimum value.

In a particular variant, control means 100 are arranged to control the motor 4 assigned to said particular group, by stopping it as soon as the operating amplitude of all the oscillators of the watches carried by supports 2 of the particular group is greater than or equal to a second, maximum value.

In another particular variant, control means 100 are arranged to control the motor 4 assigned to said particular group, by stopping it as soon as the operating amplitude of any one the oscillators of the watches carried by supports 2 of the particular group is greater than or equal to a second, maximum value.

Other control algorithms are, of course, possible.

In the case where a motor 4 is formed of several combined drive means, the control algorithm can be arranged to actuate only one, or only part, of these drive means, particularly if the energy level of energy sources 3 is low.

In all the variants, control means 100 advantageously include a user interface, which is arranged to allow the user to choose and/or to modify the first, minimum value and/or the second, maximum value for at least one particular support 2, according to the watch received by said support.

The user interface can comprise different inputs: a connection to a network or to a computing or electronic device, an antenna for wireless data transmission, selectors. These selectors may be analogue or digital with a screen/keyboard or suchlike. In this analogue version, a first selector determines the first, minimum amplitude value, and a second selector determines the second, maximum value.

In a particular manner, this user interface is arranged to allow the user to choose and/or to modify the first, minimum value and/or the second, maximum value for each said particular support 2.

In particular, this user interface is arranged to collect data relating to the first, minimum value and/or the second, maximum value for a determined watch type, especially, but not limited to by data link or by wireless communication.

In a particular variant, the user interface comprises reading means, which are arranged on at least one support 2, and which are arranged to find and read the parameters of the first, minimum value and/or second, maximum value stored in a watch in a communication interface comprised in the watch, for example an RFID chip or similar. More particularly, each support 2 is equipped with such reading means.

And, advantageously, control means 100 are then arranged to adjust, for a given support 2 comprising said reading means, the parameters of the first, minimum value and/or second, maximum value read by the reading means.

In an advantageous embodiment, at least one support 2 includes means for detecting the presence or absence of a watch, for example of the optical or capacitive or galvanic or RFID inductive or other type, which are arranged to communicate to control means 100 information as to the presence or absence of a watch, in order to annihilate the effect of a zero-amplitude signal if there are no watches on support 2. More particularly, all of supports 2 are so equipped. This detection allows the equipment concerned to be placed on standby.

For ordinary types of watch, the angular separation between the first, minimum amplitude value and/or the second, maximum amplitude value is advantageously chosen to be less than or equal to 20°.

More particularly, the first, minimum amplitude value is 240° and the second, maximum amplitude value is 260°.

For commercial use, control means 100 advantageously comprise, in the calculating means, timing means, which can determine the time slots in which a watch can be wound, and those in which it must remain immobile, particularly in an indexing position. To this end, the user interface advantageously includes timing inputs allowing the user easily to determine these time slots. The calculating means then immobilise the motor or motors 4 in an indexing position which corresponds to a predefined indexing position of the watch or watches.

The invention also concerns a timepiece assembly comprising such a device 1, and at least one watch, either a so-called mechanical watch, or an electronic watch with a mechanical power source, which is arranged to be fixed on at least one such support 2. Advantageously, the watch includes a communication interface which is arranged to communicate the first, minimum value and/or the second, maximum value which are specific to the watch.

Sensor means 20 are preferably of the microphone type.

It is clear that the measurement depends on the type of watch movement. The winding device can be paired with a particular watch, and preconfigured in the factory.

The user adjustment presented above allows the user to select, on the device, one of the standard configurations proposed by selectors in the device in order to set the amplitude thresholds. The user can also use a mobile application, allowing him to choose the watch product and to send the corresponding configuration by wireless or computer or other means of communication.

The user can also directly photograph the watch, or the warranty card, or the watch brand, or a particular area of the watch containing an appropriate code, for example using a mobile telephone or another similar portable device, to then obtain, via a mobile application, the parameters appropriate to his winder.

The watch itself may comprise a chip with its parameters, or its packaging may comprise a graphic code or also a chip, readable by an appropriate reader.

The invention also concerns the use of such a device 1 for the winding of at least one electronic watch including a generator with a mechanical energy source; in such case, its control means 100 comprise measuring means 10 which incorporate sensor means 20 adapted for measurement of the field produced by this generator in order to control regulation of the energy recharge.

The invention further concerns a method for preparing a watch, characterized in that the following steps are performed:

the watch is placed on a device 1 the angular position in which the watch rate is most accurate is determined, i.e. where the rate error is minimal;

the degree of winding, when the watch has a mechanical energy source, or the degree of charging, when the watch has an electrical energy source, at which the rate of the watch is the most stable, is determined;

the watch is held both in the angular position, and in said degree of winding, or respectively said degree of charging, corresponding to the optimum rate of the watch.

More particularly, the parameters of the angular position, on the one hand, and said degree of winding, or respectively said degree of charging, on the other hand, which correspond to the optimum rate of the watch, are stored. These parameters may, depending on the case, be stored in storage means comprised in the watch itself, or associated with the individual watch brand, which is stored with the other parameters, so as to be made available exclusively to dealers approved by the watch manufacturer.

More particularly, the watch is equipped with means for adjusting the inertia of a resonator wheel set when the watch has a mechanical resonator.

In particular, it is advantageous to use a method for micro-adjustment of the oscillator's operation, as described in European Patent Application EP15176957.7, by the same Applicant, or a similar system.

More particularly, said inertia adjustment is performed by laser when said resonator wheel set is a balance.

More particularly, said inertia adjustment is made by correction using a time-setting control stem when the watch comprises such a stem.

In short, by adjusting the amplitude and rest position of the watch, it is possible to minimise the rate error, and thus obtain a watch, particularly a mechanical watch, which is always accurate while it is on the winding device. The rate measurement is performed, more particularly, with the same sensors used for the amplitude measurement.

What is claimed is:

1. A watch winding device comprising:

at least one energy source, arranged to power at least one motor, arranged either to turn a winding crown of a manually wound watch, or to drive at least one oscillating weight of a self-winding automatic watch, or to rock at least one self-winding automatic watch;

control circuitry which includes first acoustic measuring circuitry which incorporates a sensor for acoustic measurement of an oscillator of at least one watch placed in a winding position, said control circuitry being arranged to analyse signals transmitted by said first acoustic measuring circuitry and to compare said signals to target values which correspond to the watch winding device to regulate an operation of at least one said motor by starting said motor when an operating amplitude of said oscillator is less than or equal to a first, minimum value, and by stopping said motor when the operating amplitude of said oscillator is higher than or equal to a second, maximum value, said first acoustic measuring circuitry arranged in a fixed position in a base behind an entry orifice; and at least one acoustic duct, which places a receiving port located inside a chamber for housing the watch, in communication with a transmitting port, and wherein said control circuitry controls a drive motor, which determines the motion and position in space of said transmitting port, in order, during a programmed or user-initiated operation to measure the rate of the watch fixed inside said housing, to position and immobilise said transmitting port in an indexing position facing said sensing opening and in immediate proximity to the latter or to the contact thereof.

2. The device according to claim 1, wherein said device includes second acoustic measuring circuitry for measuring ambient noise in proximity to said device during the measurement, and wherein said control circuitry is arranged to correct, by subtracting said ambient noise, the acoustic measurement made by said first acoustic measuring circuitry during said measuring operation.

3. The device according to claim 1, wherein said device includes at least one support, which is movable with respect to said base, said at least one support being arranged for receiving the watch in the winding position, wherein each said support includes one said acoustic duct, wherein said transmitting port is located at the periphery of said support, and wherein said control circuitry controls the drive motor which determines the motion and position in space of said support, in order, during a programmed or user-initiated operation to measure the rate of the watch fixed inside said housing, to position and immobilise said transmitting port in the indexing position facing said sensing opening and in immediate proximity to the latter or to the contact thereof.

4. A timepiece assembly comprising a device according to claim 3, and at least one watch, which is arranged to be fixed on at least one said support.

5. A method for preparing a watch, wherein the following is performed:

said watch is placed on said device according to claim 1;

the angular position in which the rate of said watch is most accurate is determined;

the degree of winding, when said watch has a mechanical energy source, at which the rate of the watch is the most stable, is determined;

said watch is held both in said angular position, and in said degree of winding, corresponding to the optimum rate of said watch.

* * * * *